US008900020B2

(12) United States Patent
Aoki et al.

(10) Patent No.: US 8,900,020 B2
(45) Date of Patent: Dec. 2, 2014

(54) CRIMPING TERMINAL, AND CRIMPING STRUCTURE OF CRIMPING TERMINAL AGAINST ELECTRIC WIRE

(75) Inventors: Hiroshi Aoki, Toyota (JP); Osamu Oshita, Toyota (JP); Naoki Kobayashi, Toyoto (JP)

(73) Assignee: Yazaki Corporation, Tokyo (JP)

( * ) Notice: Subject to any disclaimer, the term of this patent is extended or adjusted under 35 U.S.C. 154(b) by 140 days.

(21) Appl. No.: 13/583,242

(22) PCT Filed: Mar. 23, 2011

(86) PCT No.: PCT/JP2011/056970

§ 371 (c)(1),
(2), (4) Date: Sep. 7, 2012

(87) PCT Pub. No.: WO2011/118624

PCT Pub. Date: Sep. 29, 2011

(65) Prior Publication Data

US 2013/0045644 A1 Feb. 21, 2013

(30) Foreign Application Priority Data

Mar. 23, 2010 (JP) ..... 2010-066855

(51) Int. Cl.
*H01R 11/22* (2006.01)
*H01R 4/18* (2006.01)

(52) U.S. Cl.
CPC ..... *H01R 4/183* (2013.01)
USPC ..... 439/851; 439/885

(58) Field of Classification Search
CPC ..... H01R 12/69; H01R 13/5808
USPC ..... 439/851–852, 882–885
See application file for complete search history.

(56) References Cited

U.S. PATENT DOCUMENTS 3,818,121 A * 6/1974 Hilton et al. ..... 174/84 C
3,964,815 A * 6/1976 McDonough ..... 439/423

(Continued)

FOREIGN PATENT DOCUMENTS

JP 3910920 4/1964
JP 53128532 3/1977

(Continued)

OTHER PUBLICATIONS

Office Action, dated Jan. 30, 2013, issued by the Japanese Patent Office in counterpart Japanese Application No. 2010-066855.

(Continued)

*Primary Examiner* — Truc Nguyen
(74) *Attorney, Agent, or Firm* — Sughrue Mion, PLLC

(57) ABSTRACT

The upper surface panel 15 and the lower surface 14 of the electric wire connection portion of the crimping terminal 10 are formed in such a cross-sectional shape that when placed and joined together an internal space is formed therein to house the end portion of an electric wire W and also such that when the interior is compressed and sealed by receiving crimping force from an vertical direction the end portion of the electrical connection is crimped thereby. Further, an electric wire insertion aperture 17 is provided in the junction 16 between the lower surface panel 14 and the upper surface panel 15 to allow the end portion of the electric wire W to be inserted therebetween.

7 Claims, 10 Drawing Sheets

(56) References Cited

U.S. PATENT DOCUMENTS

| | | | | | |
|---|---|---|---|---|---|
| 4,692,122 | A | * | 9/1987 | Montalbano | 439/882 |
| 5,616,041 | A | * | 4/1997 | Brown et al. | 439/222 |
| 5,897,405 | A | * | 4/1999 | Endo | 439/852 |
| 6,080,018 | A | * | 6/2000 | Ferrill et al. | 439/607.47 |
| 6,142,816 | A | * | 11/2000 | Kameyama | 439/394 |
| 6,428,366 | B1 | * | 8/2002 | Purushothaman et al. | 439/851 |
| 6,447,345 | B2 | * | 9/2002 | Sato et al. | 439/852 |
| 6,860,768 | B2 | * | 3/2005 | Zhao | 439/852 |

FOREIGN PATENT DOCUMENTS

| | | | |
|---|---|---|---|
| JP | 03-116667 | A | 5/1991 |
| JP | 587822 | | 11/1993 |
| JP | 07-302632 | A | 11/1995 |
| JP | 2009087848 | A | 4/2009 |

OTHER PUBLICATIONS

International Search Report dated May 24, 2011 issued by the International Searching Authority in International Application No. PCT/JP2011/056970.

Office Action dated Jul. 2, 2014, issued by The State Intellectual Property Office of the People's Republic of China in counterpart Chinese Patent Application No. 201180015568.5.

* cited by examiner

CRIMPING TERMINAL, AND CRIMPING STRUCTURE OF CRIMPING TERMINAL AGAINST ELECTRIC WIRE

CROSS-REFERENCE TO RELATED APPLICATIONS

This application is a National Stage entry of International Applications PCT/JP2011/056970 filed Mar. 23, 2011, which claims the benefit of priority of Japanese Patent Application No. 2010-066855 filed Mar. 23, 2010, in the Japanese Patent Office (JPO), the disclosures of all of which are incorporated herein in their entirety.

TECHNICAL FIELD

The present invention relates to a crimping terminal and a crimping structure of the crimping terminal to an electric wire.

BACKGROUND ART

FIGS. 13(*a*) and (*b*) illustrate a crimping terminal and a crimping structure of a electric wire disclosed in PTL 1.

A crimping terminal 210 has an electrical connection portion 211 connected to a battery or the like at the front thereof and has an electric wire connection portion 212 which is crimped are connected to the end portion of an electric wire W at the rear thereof. The electric wire connection portion 212 has a base plate portion 221 and a conductor crimping piece 222 and as shown in FIG. 13(*a*), a crimper 280 is lowered and thereby the conductor crimping piece is crimped. Thus, as shown in FIG. 13(*b*), the crimping terminal 210 is crimped and makes contact with a conductor Wa of the electric wire W.

CITATION LIST

Patent Literature

[PTL 1] JP-A-2009-87848

SUMMARY OF INVENTION

Technical Problem

However, in the crimping terminal and the crimping structure of the electric wire described above, since there are many portions where the conductor Wa of the electric wire W connected to the crimping terminal 210 is exposed to the outside, if moisture becomes attached to the conductor Wa, the conductor Wa has a tendency to corrode and as a result, there is a concern that reliability of electrical connection will be lost.

The invention has been made in light of such circumstances, and has an object of providing a crimping terminal and a crimping structure of the crimping terminal to an electric wire which can eliminate corrosion problems of a conductor of the electric wire and the concern that reliability of electrical connection will be lost can be solved even if moisture becomes attached to the electric wire connection portion.

Solution to Problem

In order to obtain the object described above, a crimping terminal of the invention is characterized by (1) and (2) described below.

(1) A crimping terminal, which has an electrical connection portion for connecting to a counterpart terminal at the front portion thereof and has an electric wire connection portion that is crimped is connected to an end portion of an electric wire at the back portion thereof, wherein the electric wire connection portion includes a lower surface panel which is continuous with a base plate portion of the electric wire connection portion and an upper surface panel which extends from a back end of the lower surface panel and is positioned above the lower surface panel by being folded upwards and forwards at a junction with the lower surface panel, wherein the upper surface panel and the lower surface are formed in such a cross-sectional shape that when placed and joined together, an internal space is formed therein to house the end portion of the electric wire and such that when the interior is compressed and sealed by receiving crimping force from the vertical direction, thereby crimping the end portion of the electric wire, and wherein an electric wire insertion aperture is provided in a folded portion from the lower surface panel to the upper surface panel to allow the end portion of the electric wire to be inserted between the lower surface panel and the upper surface panel.

(2) The crimping terminal according to (1) described above, wherein engaging portions are provided which are engaged when a crimping force is received from the vertical direction at both edges of the lower surface panel and the both edges of the upper surface panel.

According to the crimping terminal of the configuration (1) described above, the end portion of the electric wire is inserted and crimped between the lower surface panel and the upper surface panel and thereby the interior thereof can be sealed and the conductor can be protected from the penetration of moisture.

According to the crimping terminal of the configuration (2) described above, the engaging portions are provided at both edges of the lower surface panel and both edges of the upper surface panel respectively, and engage when crimping so that the fixing force can be increased.

In order to obtain the object described above, the crimping structure of the crimping terminal against the electric wire of the invention is characterized by (3) described below.

(3) A crimping structure of a crimping terminal against an electric wire, which an end portion of the electric wire is inserted from the electric wire insertion aperture of the crimping terminal of (1) and (2) described above, thereby inserting the electric wire from a tip of a conductor which is exposed by removing an insulated coating to an insulated coating portion between the lower surface panel and the upper surface panel, and wherein in this state, the upper surface panel is crimped and fixed to the lower surface panel, the end portion of the electric wire is covered in a sealed state by the lower surface panel and the upper surface panel in a range where the end portion is inserted between the lower surface panel and the upper surface panel and at the same time, and the conductor is crimped between the lower surface panel and the upper surface panel.

According to the crimping structure of the configuration (3) described above, the end portion of the electric wire is inserted and crimped between the lower surface panel and the upper surface panel and thereby the conductor is crimped at the sealed space between the lower surface panel and the upper surface panel and the conductor can be protected from the penetration of moisture.

Advantageous Effects of Invention

According to the invention, even though the moisture becomes attached to the connection portion between the crimping terminal and the connection portion of the electric wire, the moisture cannot penetrate through to the conductor of the electric wire and the corrosion problems of the conductor of the electric wire can be prevented. As a result, the concern that the reliability of the electrical connection will be lost can be eliminated.

Hereinabove, the invention is described briefly. Furthermore, details of the invention will be further clarified by reading the embodiments of the invention described below with reference to the annexed drawings.

DESCRIPTION OF EMBODIMENTS

Hereinafter, each of embodiments of the invention is described with reference to drawings.

In addition, in the invention, a connecting side to a counterpart terminal of a crimping terminal is referred to as forwards and a connecting side to the electric wire of the crimping terminal is referred to as backwards.

First Embodiment

Figure 1A:
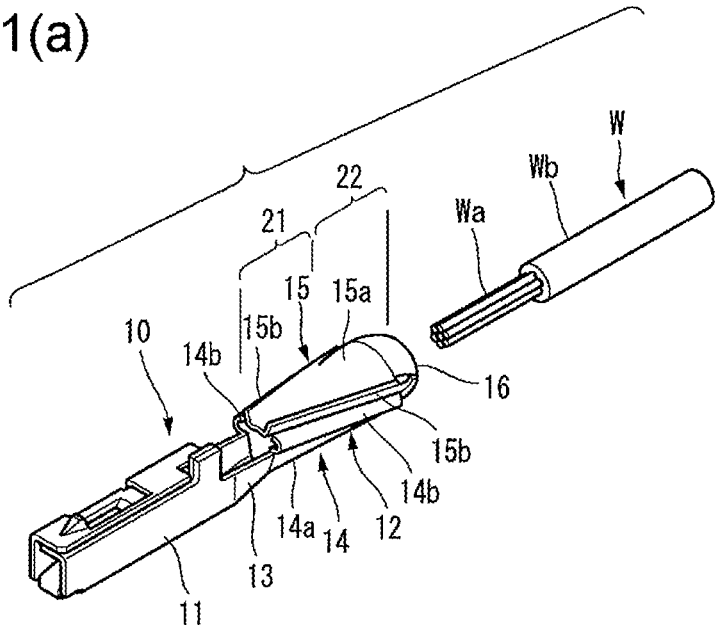
FIGS. 1(*a*) and (*b*) are diagrams of a crimping terminal of a first embodiment of the invention, FIG. 1(*a*) is a perspective view of the crimping terminal seen from an inclined frontal direction and FIG. 1(*b*) is a perspective view of the crimping terminal seen from an inclined posterior direction.
Figure 1B:
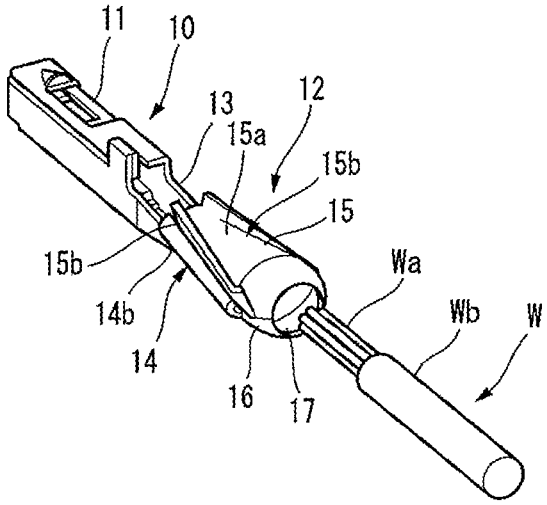
Figure 2:
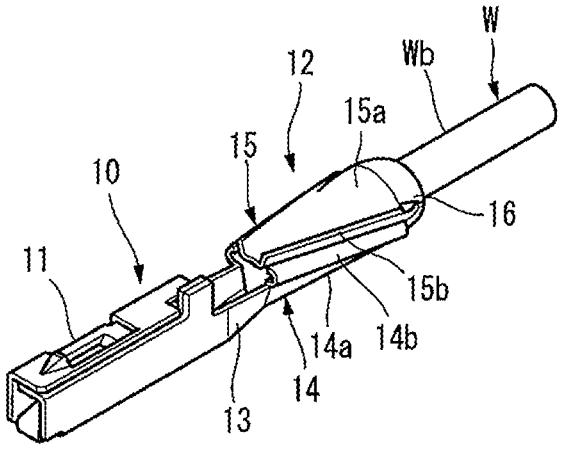
FIG. 2 is a perspective view illustrating a state where an end portion of an electric wire is inserted from an electric wire insertion aperture at a back end of the crimping terminal into an electric wire connection portion.
Figure 3:
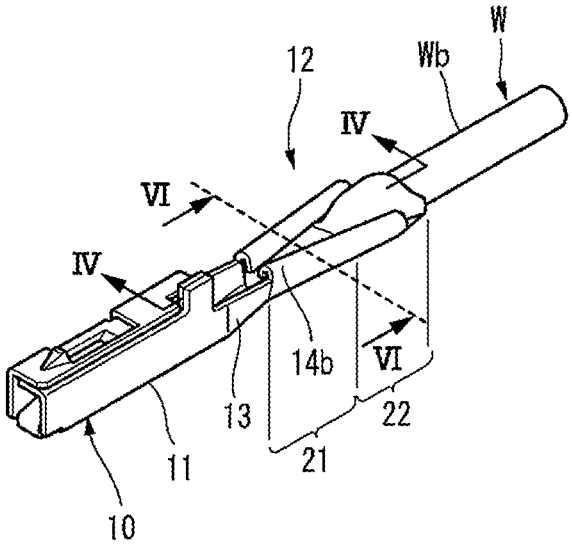
FIG. 3 is a perspective view illustrating a state where a crimping terminal and an electric wire are connected by performing a crimping process from the state shown in FIG. 2.
Figure 4:
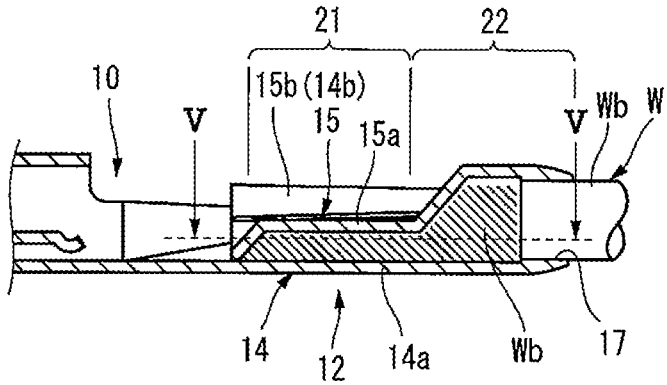
FIG. 4 is a cross-sectional view seen from arrows IV-IV in FIG. 3.
Figure 5:
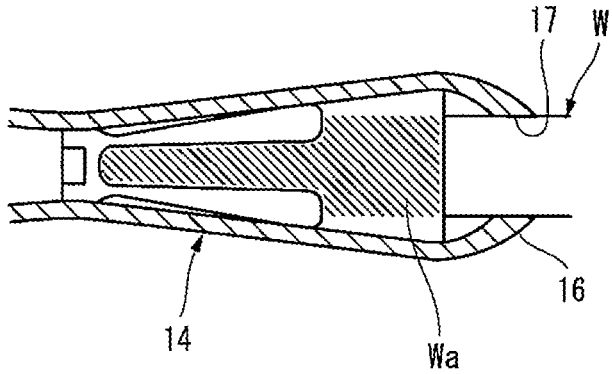
FIG. 5 is a cross-sectional view seen from arrows V-V in FIG. 4.
Figure 6:
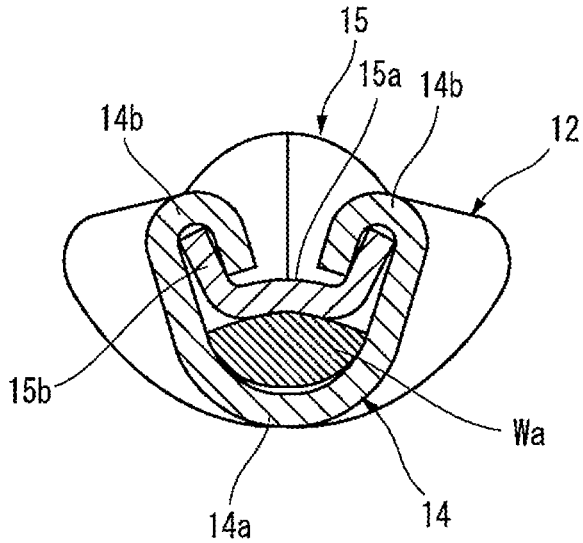
FIG. 6 is a cross-sectional view seen from arrows VI-VI in FIG. 3.
Figure 7:
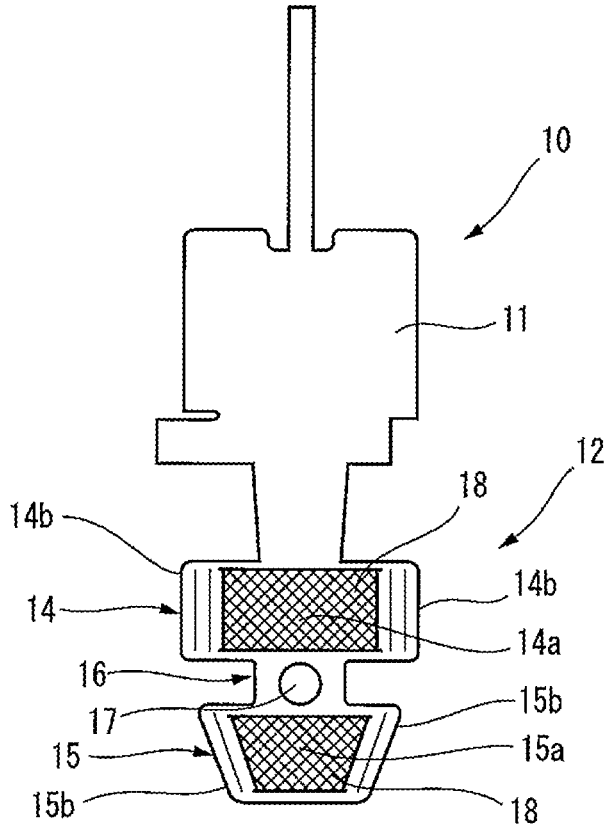
FIG. 7 is a development view of the crimping terminal.
Figure 8A:
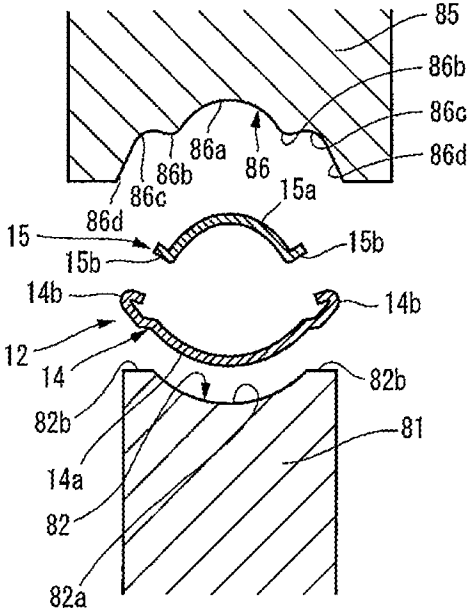
FIGS. 8(*a*) to (*c*) are explanatory views of a crimping mold of the electric wire connection portion of the crimping terminal, FIG. 8(*a*) is a cross-sectional view of a pre-crimping state of a conductor crimping portion seen from the front thereof, FIG. 8(*b*) is a cross-sectional view of a crimping state of the conductor crimping portion seen from the front thereof, and FIG. 8(*c*) is a longitudinal-sectional view of a crimping type crimping terminal along the longitudinal direction thereof.
Figure 8B:
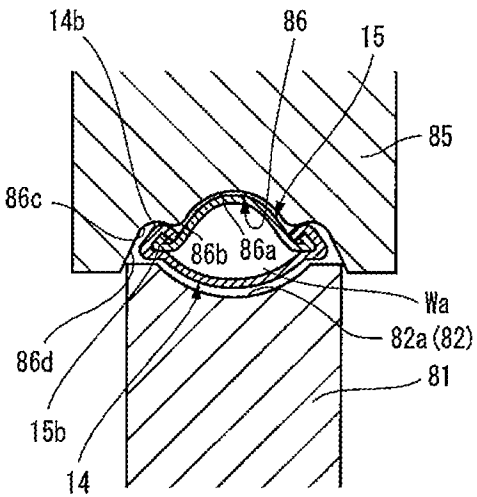
Figure 8C:
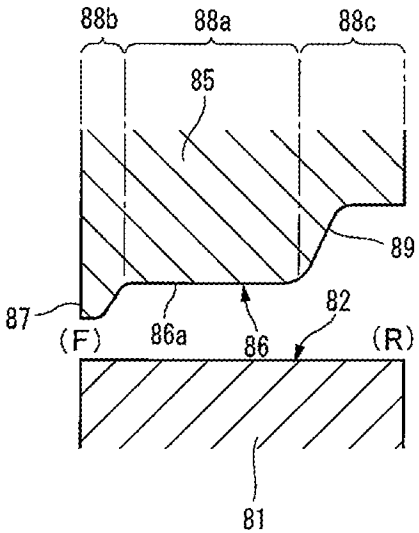

FIGS. 1(*a*) and (*b*) are a diagrams of a crimping terminal of a first embodiment of the invention, FIG. 1(*a*) is a perspective view of the crimping terminal seen from the inclined frontal direction and FIG. 1(*b*) is a perspective view of the crimping terminal seen from the inclined posterior direction, FIG. 2 is a perspective view illustrating a state where an end portion of an electric wire is inserted from an electric wire insertion aperture at a back end of the crimping terminal into an electric wire connection portion, FIG. 3 is a perspective view illustrating a state where a crimping terminal and an electric wire are connected by performing the crimping process from the state shown in FIG. 2, FIG. 4 is a cross-sectional view seen from arrows IV-IV in FIG. 3, FIG. 5 is a cross-sectional view seen from arrows V-V in FIG. 4, FIG. 6 is a cross-sectional view seen from arrows VI-VI in FIG. 3, FIG. 7 is a development view of the crimping terminal, and FIGS. 8(*a*) to (*c*) are explanatory views of a crimping mold of the electric wire connection portion of the crimping terminal, FIG. 8(*a*) is a cross-sectional view of a pre-crimping state of a conductor crimping portion seen from the front thereof, FIG. 8(*b*) is a cross-sectional view of a crimping state of the conductor crimping portion seen from the front thereof, and FIG. 8(*c*) is a longitudinal-sectional view of a crimping type crimping terminal along a longitudinal direction thereof.

As shown in FIGS. 1(*a*) to 2, a crimping terminal 10 is a female type and has a box-type electrical connection portion 11 having a built-in spring piece for connecting to a counterpart terminal or the like (not shown) at the front portion and has an electric wire connection portion 12 that is crimped are connected to the end portion of an electric wire W at the back portion through a joint portion 13.

The electric wire connection portion 12 is configured of a conductor crimping portion 21 as a first half and a coated crimping portion 22 as a second half. As shown in FIG. 7, the electric wire connection portion 12 is configured of a lower surface panel 14 that is continuous with a base plate portion of the electrical connection portion 11 and an upper surface panel 15 that extends further backwards at the back end of the lower surface panel 14 and in a next press step, folds upwards and forwards at a junction (a folded portion 16) with the lower surface panel 14 so as to be positioned above the lower surface panel 14.

The upper surface panel 15 and the lower surface panel 14 are formed in a cross-sectional shape that when placed and joined together an internal space is formed therein to house the end portion of the electric wire W and also such that when the interior is crimped and sealed by receiving crimping force from an vertical direction. In other words, the lower surface panel 14 is formed in a semicircular arc cross section having a middle portion 14*a* and engaging portions 14*b* wherein the middle portion 14*a* is convexly curved downwards in the width direction thereof, and the engaging portions 14*b* connect to and engage with engaging portions 15*b* provided at both edges of the upper surface panel 15, when both edges thereof receive a crimping force from the vertical direction and are crimped. In addition, the upper surface panel 15 is formed in a semicircular arc cross section having a middle portion 15*a* and the engaging portions 15*b* wherein the middle portion 15*a* is convexly curved upwards in the width direction thereof, and the engaging portions 15*b* connect to and engage with the engaging portions 14*b* provided at both edges of the lower surface panel 14, when both edges thereof receive the crimping force from the vertical direction and are crimped. As shown in FIG. 1 in the first embodiment, the engaging portion 15*b* of the upper surface panel 15 is formed as an edge portion curved upwards and the engaging portion 14*b* of the lower surface panel 14 is formed as a reverse U-shaped hook portion engaging the edge portion to wrap up the edge portion.

In addition, as shown in FIGS. 1(*b*) and 7, at the junction 16 from the lower surface panel 14 to the upper surface panel 15, a substantially circular electric wire insertion aperture 17 is formed in order to insert the end portion of the electric wire W between the lower surface panel 14 and the upper surface panel 15. The diameter of the electric wire insertion aperture 17 is set to be substantially the same as the outer diameter of an insulated coating Wb of the electric wire W. In addition, at an inner surface (an upper surface) of the lower surface panel 14 and an inner surface (a lower surface) of the upper surface panel 15, knurled serrations 18 are formed to increase the contact conductivity between the electric wire and the conductor during crimping.

In order to obtain a connection structure of the first embodiment, as shown in FIG. 2, the end portion of the electric wire W is inserted from the electric wire insertion aperture 17 at the back end of the crimping terminal 10 thereby inserting the electric wire W from a tip of a conductor Wa which is exposed by removing the insulated coating Wb to a portion where the insulated coating Wb is attached between the lower surface panel 14 and the upper surface panel 15. Thus, as shown in FIGS. 3 to 5, in this state, the first half (a range corresponding to the conductor crimping portion 21) of the upper surface panel 15 is crimped strongly against the lower surface panel 14 and thereby the conductor Wa of the electric wire W inserted between the first halves of the lower surface panel 14 and the upper surface panel 15 is crimped while covered by the lower surface panel 14 and the upper surface panel 15 in a sealed state. At the same time, the second half (a range corresponding to the coated crimping portion 22) of the upper surface panel 15 is crimped lightly against the lower surface panel 14 and thereby the attached portion of the insulated coating Wb of the electric wire inserted between the lower surface panel 14 and the upper surface panel 15 is held. In addition, at this time, as shown in FIG. 6, the engaging portions 14*b* of both edges of the lower surface panel 14 and the engaging portions 15*b* of both edges of the upper surface panel 15 are engaged, and the lower surface panel 14 and the upper surface panel 15 are strongly crimped and fixed to avoid deformation in the opening direction thereof. As described above, the crimping structure of the crimping terminal 10 against the electric wire W can be obtained.

In addition, as shown in FIGS. 8(*a*) and (*b*), the mold performing the crimping process as described above, is configured by assembling a crimper (an upper mold) 85 and an anvil (a lower mold) 81, and a machining curved surface 82, where the lower surface of the lower surface panel 14 is mounted, is provided at the anvil 81 as a portion which caulks the range of the conductor crimping portion 21. A machining curved surface 86, which exerts a pressing force on the upper surface of the upper surface panel 15 is provided at the crimper 85.

The machining curved surface 82 of the anvil 81 includes a middle machining surface 82*a* that presses the middle portion 14*a* of the lower surface panel 14 in the width direction and an end portion machining surface 82*b* that supports while pressing the engaging portions 14*b* of both ends of the lower surface panel 14 in the width direction. In addition, the machining curved surface 86 of the crimper 85 includes a middle machining surface 86*a* that presses the middle portion 15*a* of the upper surface panel 15 in the width direction, a mountain-shaped portion 86*b* that catches the engaging portions 15*b* of both ends of the upper surface panel 15 in the width direction, and a slope machining surface 86*d* and a curved machining surface 86*c* which is formed at both outsides of the mountain-shaped portion 86*b*, gradually rolls the engaging portions 14*b* of the lower surface panel 14 inwards along with the falling of the crimper 85, and finally caulks the engaging portions 14*b* of the lower surface panel 14 to the engaging portions 15*b* of the upper surface panel 15.

In addition, as shown in FIG. 8(*c*), a portion 88*a* that caulks the conductor crimping portion 21 of the crimping terminal 10 along the longitudinal direction of the crimping terminal 10, a portion 88*b* that is positioned forwards of the portion 88*a* that caulks the conductor crimping portion 21 and is attached to a protrusion 87 which further compresses the upper surface panel 15 of the tip of the conductor crimping portion 21, and a portion 88*c* that is positioned backwards of the portion 88*a* that caulks the conductor crimping portion 21 and has a portion 89 which caulks the coated crimping portion 22 are divided and provided at the crimper 85.

According to the crimping terminal 10 having the configuration described above and the crimping structure using the crimping terminal 10, the end portion of the electric wire W is inserted and crimped between the lower surface panel 14 and the upper surface panel 15, and thereby the interior thereof can be sealed and the conductor Wa of the electric wire W can be protected from penetration of moisture. Moreover, since the engaging portions 14*b* of the lower surface panel 14 and the engaging portions 15*b* of the upper surface panel 15 can be crimped and engaged, the fixing force of the upper surface panel 15 and the lower surface panel 14 against the opening direction thereof can be increased. As a result, the corrosion problems of the conductor Wa of the electric wire W can be prevented and the concern that the reliability of the electrical connection will be lost can be eliminated.

Second Embodiment

Figure 9A:
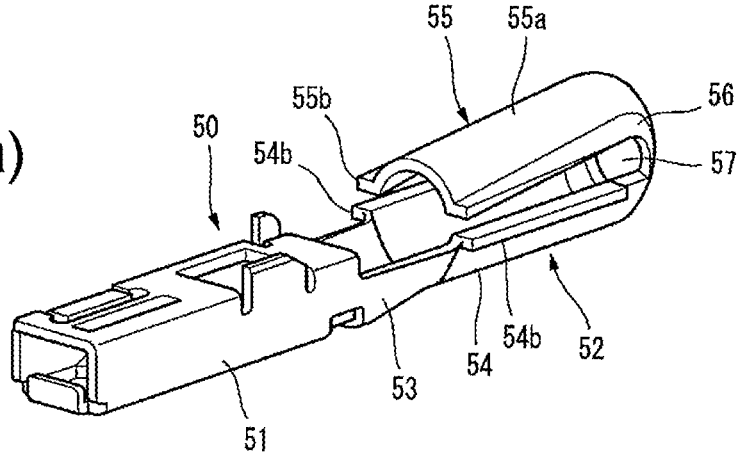
FIGS. 9(*a*) and (*b*) are diagrams of a crimping terminal of a second embodiment of the invention, FIG. 9(*a*) is a perspective view of the crimping terminal seen from the inclined frontal direction and FIG. 9(*b*) is a perspective view of the crimping terminal seen from the inclined posterior direction.
Figure 9B:
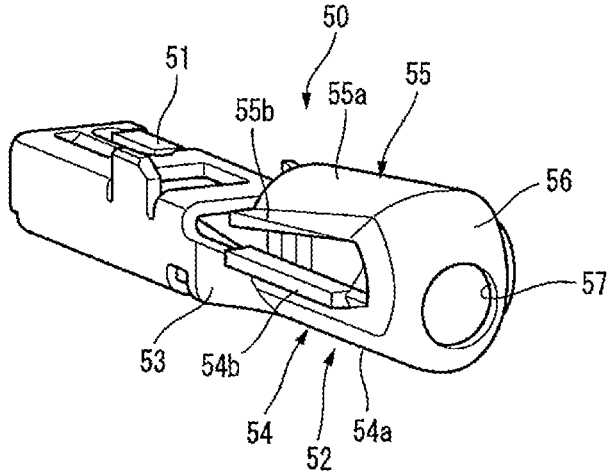
Figure 10A:
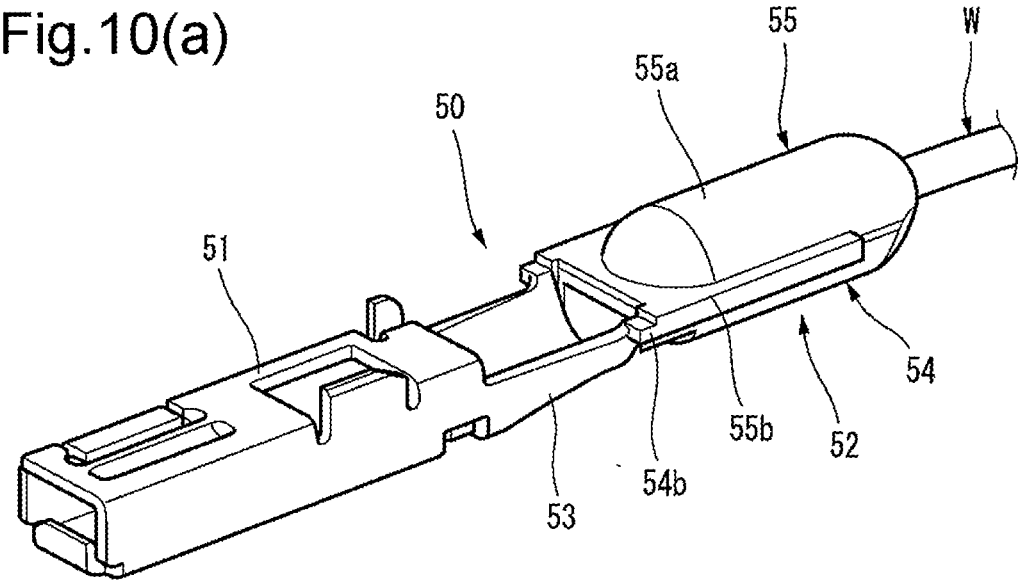
FIG. 10(*a*) is a perspective view illustrating a state where the end portion of the electric wire is inserted from the electric wire insertion aperture at the back end of the crimping terminal into the electric wire connection portion and FIG. 10(*b*) is a cross-sectional view of the conductor crimping portion.
Figure 10B:
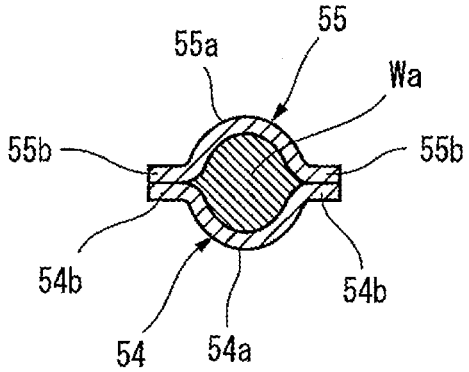
Figure 11:
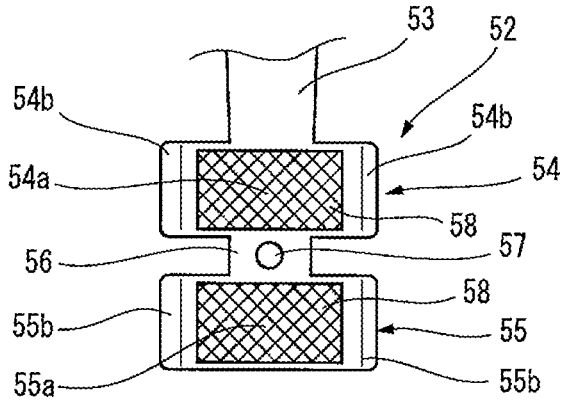
FIG. 11 is a development view of a main portion of the crimping terminal.
Figure 12:
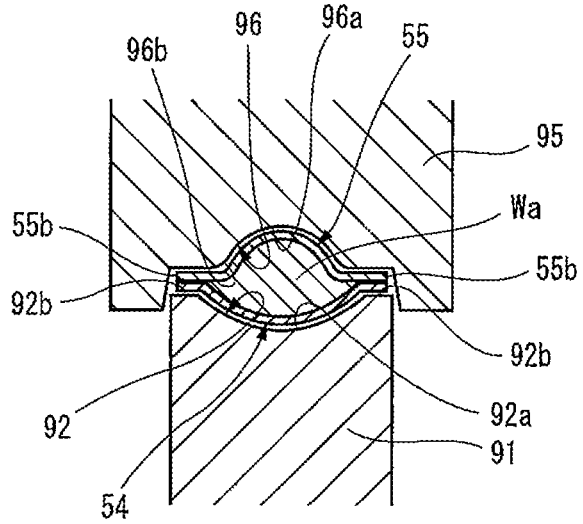
FIG. 12 is an explanatory view of the crimping mold of the electric wire connection portion of the crimping terminal and a cross-sectional view illustrating a state where the conductor crimping portion is crimped seen from the front thereof.
Figure 13A:
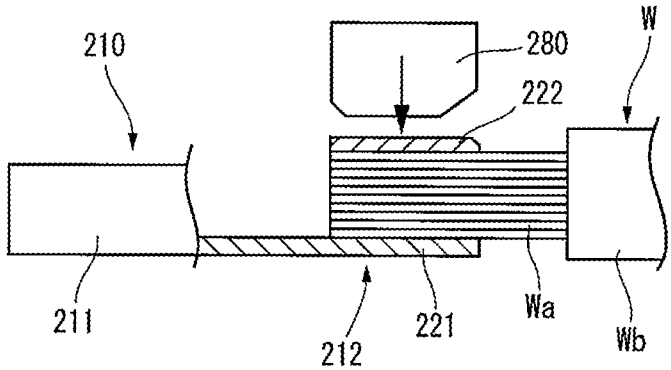
FIGS. 13(*a*) and (*b*) are views illustrating a crimping structure of the crimping terminal against the electric wire of the related art, FIG. 13(*a*) is a side cross-sectional view illustrating a pre-crimping state, and FIG. 13(*b*) is a side cross-sectional view illustrating a post-crimping state.
Figure 13B:
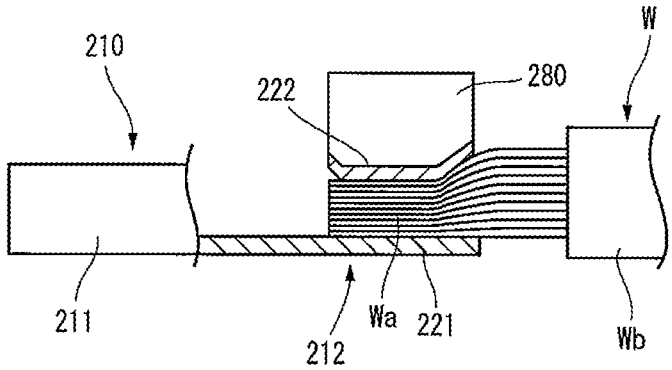

FIGS. 9(*a*) and (*b*) are diagrams of a crimping terminal of a second embodiment of the invention, FIG. 9(*a*) is a perspective view of the crimping terminal seen from the inclined frontal direction and FIG. 9(*b*) is a perspective view of the crimping terminal seen from the inclined posterior direction, FIG. 10(*a*) is a perspective view illustrating a state where the end portion of the electric wire is inserted from the electric wire insertion aperture at the back end of the crimping terminal into the electric wire connection portion and FIG. 10(*b*) is a cross-sectional view of the conductor crimping portion, FIG. 11 is a development view of a main portion of the crimping terminal, and FIG. 12 is an explanatory view of the crimping mold of the electric wire connection portion of the crimping terminal and cross-sectional view illustrating a state where the conductor crimping portion is crimped seen from the front thereof.

As shown in FIGS. 9(*a*) and 9(*b*), a crimping terminal 50 is a female type and has a box-type electrical connection portion 51 having a built-in spring piece for connecting to the counterpart terminal or the like (not shown) at the front side and has an electric wire connection portion 52 that is crimped are connected to the end portion of the electric wire W at the back portion through a joint portion 53.

As shown in FIG. 11, the electric wire connection portion 52 is configured of a lower surface panel 54 that is continuous with a base plate portion of the electrical connection portion 51 and an upper surface panel 55 that extends further backwards at the back end of the lower surface panel 54 and in a next press step, folds upwards and forwards at a junction (a folding portion 56) with the lower surface panel 54 so as to position above the lower surface panel 54.

The upper surface panel 55 and the lower surface panel 54 are formed in a cross-sectional shape that when placed and joined together an internal space is formed therein to house the end portion of the electric wire W and also such that when the interior is crimped and sealed by receiving crimping force from the vertical direction. In other words, the lower surface panel 54 is formed in a semicircular arc cross section having a middle portion 54*a* and flange portions 54*b* wherein the middle portion 54*a* is convexly curved downwards in the width direction thereof, and the flange portions 54*b* connect and engage with flange portions 55*b* provided at both edges of the upper surface panel 55, when both edges thereof receive the crimping force from the vertical direction and are crimped. In addition, the upper surface panel 55 is formed in a semicircular arc cross section having a middle portion 55*a* and the flange portions 55*b* wherein the middle portion 55*a* is convexly curved upwards in the width direction thereof, and the flange portions 55*b* connect and engage with the flange portions 54*b* provided at both edges of the lower surface panel 54, when both edges thereof receive the crimping force from the vertical direction and are crimped.

In addition, as shown in FIGS. 9(*b*) and 11, at a junction 56 from the lower surface panel 54 to the upper surface panel 55, a substantially circular electric wire insertion aperture 57 is formed in order to insert the end portion of the electric wire W between the lower surface panel 54 and the upper surface panel 55. The diameter of the electric wire insertion aperture 57 is set to be substantially the same as the outer diameter of the insulated coating Wb of the electric wire W. In addition, at an inner surface (an upper surface) of the lower surface panel 54 and an inner surface (a lower surface) of the upper surface panel 55, knurled serrations 58 are formed to increase the contact conductivity between the electric wire and the conductor during crimping.

In order to obtain a connection structure of the second embodiment, as shown in FIG. 10(*a*), the end portion of the electric wire W is inserted from the electric wire insertion aperture 57 at the back end of the crimping terminal 50 and thereby inserting the electric wire W from the tip of the conductor Wa which is exposed by removing the insulated coating Wb to a portion where the insulated coating Wb is attached between the lower surface panel 54 and the upper surface panel 55. Thus, in this state, the first half (a range corresponding to the conductor crimping portion) of the upper surface panel 55 is crimped strongly against the lower surface panel 54 and thereby the conductor Wa of the electric wire inserted between the first halves of the lower surface panel 54 and the upper surface panel 55 is crimped while covered by the lower surface panel 54 and the upper surface panel 55 in a sealed state. At the same time, the second half (a range corresponding to the covering and crimping portion) of the upper surface panel 55 is crimped lightly against the lower surface panel 54 and thereby the attached portion of the insulated coating Wb of the electric wire inserted between the lower surface panel 54 and the upper surface panel 55 is held. In addition, at this time, as shown in FIG. 10(*b*), the flange portions 54*b* of both edges of the lower surface panel 54 and the flange portions 55*b* of both edges of the upper surface panel 55 are aligned, and the lower surface panel 54 and the upper surface panel 55 are strongly crimped and thereby fixed firmly to avoid deformation in the opening direction of the lower surface panel 54 and the upper surface panel 55. As described above, the crimping structure of the crimping terminal 50 against the electric wire W can be obtained.

In addition, as shown in FIG. 12, the mold performing the crimping process as described above, is configured by assembling a crimper (an upper mold) 95 and an anvil (a lower mold) 91, and a machining curved surface 92, where the lower surface of the lower surface panel 54 is mounted, is provided at the anvil 91 as a portion which caulks the range of the conductor crimping portion. A machining curved surface 96, which crimps the upper surface of the upper surface panel 55, is provided at the crimper 95.

The machining curved surface 92 of the anvil 91 includes a middle machining surface 92*a* that crimps the middle portion 54*a* of the lower surface panel 54 in the width direction and an end portion machining surface 92*b* that supports while crimping the flange portions 54*b* of both ends of the lower surface panel 54 in the width direction. In addition, the machining curved surface 96 of the crimper 95 includes a middle machining surface 96*a* that crimps the middle portion 55*a* of the upper surface panel 55 in the width direction, and an end portion machining surface 96*b* that crimps the flange portions 55*b* of both ends of the upper surface panel 55 in the width direction.

According to the crimping terminal 50 having the configuration described above and the crimping structure using the crimping terminal 50, the end portion of the electric wire W is inserted and crimped between the lower surface panel 54 and the upper surface panel 55, and thereby the interior thereof can be sealed and the conductor Wa of the electric wire W can be protected from penetration of moisture. Accordingly, the corrosion problems of the conductor Wa of the electric wire W can be prevented and the concern that the reliability of the electrical connection will be lost can be eliminated.

In addition, the invention is not limited to the embodiments described above, and accordingly, deformation, improvement or the like is possible. Besides, the material, shape, dimensions, number, position or the like of each of the configuration elements in the embodiments described above is optional and is not limited as long as it can achieve the invention.

The invention is described with reference to specific embodiments, however, it is clear for those skilled in the art that various change or modification can be added to the embodiments without deviating from the gist and range of the invention. This application claims benefit of Japanese Patent Application (Patent Application No. 2010-066855) filed on Mar. 23, 2010 which is hereby incorporated by reference.

REFERENCE SIGNS LIST

W ELECTRIC WIRE
Wa CONDUCTOR
Wb INSULATED COATING
10 CRIMPING TERMINAL
14 LOWER SURFACE PANEL
14*b* ENGAGING PORTION
15 UPPER SURFACE PANEL
15*b* ENGAGING PORTION
16 JUNCTION
17 ELECTRIC WIRE INSERTION APERTURE

The invention claimed is:

1. A crimping terminal, comprising:

an electrical connection portion for connecting to a counterpart terminal at a front portion of the crimping terminal; and an electric wire connection portion that is crimped is connected to an end portion of an electric wire at a back portion of the crimping terminal;

wherein the electric wire connection portion includes a lower surface panel which is continuous with a base plate portion of the electrical connection portion and an upper surface panel which extends from a back end of the lower surface panel and is positioned above the lower surface panel by being folded upwards and forwards at a junction with the lower surface panel;

wherein the upper surface panel and the lower surface panel are formed in such a cross-sectional shape that when placed and joined together, an internal space is formed therein to house the end portion of the electric wire and such that when the interior is compressed and sealed by receiving crimping force from the vertical direction, thereby crimping the end portion of the electric wire, and wherein an electric wire insertion aperture is provided in a folded portion from the lower surface panel to the upper surface panel to allow the end portion of the electric wire to be inserted between the lower surface panel and the upper surface panel.

2. The crimping terminal according to claim 1, wherein engaging portions are provided which are engaged when a crimping force is received from the vertical direction at both edges of the lower surface panel and both edges of the upper surface panel.

3. A crimping structure of a crimping terminal against an electric wire, which an end portion of the electric wire is inserted from the electric wire insertion aperture of the crimping terminal according to claim 1, thereby inserting the electric wire from a tip of a conductor which is exposed by removing an insulated coating to an insulated coating portion between the lower surface panel and the upper surface panel, and wherein in this state, the upper surface panel is crimped and fixed to the lower surface panel, the end portion of the electric wire is covered in a sealed state by the lower surface panel and the upper surface panel in a range where the end portion is inserted between the lower surface panel and the upper surface panel and at the same time, and the conductor is crimped between the lower surface panel and the upper surface panel.

4. The crimping terminal according to claim 1, wherein the end portion of the electric wire is not exposed when crimped to the crimping terminal.

5. The crimping terminal according to claim 1, wherein the electric wire is not crimped to the counterpart terminal.

6. The crimping terminal according to claim 1, wherein the end portion of the electric wire contacts both the lower surface panel and the upper surface panel when crimped.

7. The crimping terminal according to claim 1, wherein engaging portions are provided on the crimping terminal which are engaged when a crimping force is received from the vertical direction at both edges of the lower surface panel and both edges of the upper surface panel, when the engaging portions receive the crimping force from the vertical direction, the end portion of the electric wire is crimped in a state where the both edges of the lower surface panel and the both edges of the upper surface panel are compressed and the interior is sealed.

* * * * *